US006202641B1

(12) United States Patent
Lazzaro

(10) Patent No.: US 6,202,641 B1
(45) Date of Patent: Mar. 20, 2001

(54) HOOD FOR COOKING AREAS

(75) Inventor: Vittorino Lazzaro, Padua (IT)

(73) Assignee: Fox Group S.p.A., Campodarsego (IT)

( * ) Notice: Subject to any disclaimer, the term of this patent is extended or adjusted under 35 U.S.C. 154(b) by 0 days.

(21) Appl. No.: 09/355,171

(22) PCT Filed: Nov. 30, 1998

(86) PCT No.: PCT/EP98/07720

§ 371 Date: Jul. 23, 1999

§ 102(e) Date: Jul. 23, 1999

(87) PCT Pub. No.: WO99/28680

PCT Pub. Date: Jun. 10, 1999

(30) Foreign Application Priority Data

Dec. 2, 1997 (IT) ..... PD970086 U

(51) Int. Cl.[7] ..... F24C 15/20

(52) U.S. Cl. ..... 126/299 D; 126/299 F; 454/63; 55/DIG. 36

(58) Field of Search ..... 126/299 R, 299 D, 126/299 F; 454/49, 56, 63, 64, 65, 67; 55/DIG. 36

(56) References Cited

U.S. PATENT DOCUMENTS

| | | | | |
|---|---|---|---|---|
| 4,465,256 | | 8/1984 | Wolbrink et al. | 248/544 |
| 4,738,244 | * | 4/1988 | Welsh | 55/DIG. 36 |
| 5,154,161 | * | 10/1992 | Rogers et al. | 126/299 D |
| 5,320,088 | * | 6/1994 | Nester | 126/299 R |
| 5,718,219 | * | 2/1998 | Bouderault | 55/DIG. 36 |

FOREIGN PATENT DOCUMENTS

| | | | | |
|---|---|---|---|---|
| 3417453 | | 11/1985 | (DE) . | |
| 2-302544 | * | 12/1990 | (JP) | 126/299 D |

* cited by examiner

*Primary Examiner*—Ira S. Lazarus
*Assistant Examiner*—Josiah C. Cocks
(74) *Attorney, Agent, or Firm*—Guido Modiano; Albert Josif; Daniel O'Byrne

(57) ABSTRACT

A hood to be mounted against a wall above a cooking area, comprising filtering elements and fan means which are integrated in a supporting frame and are connected to a control device. The hood further comprises a depth compensation device which is constituted by a contoured lamina arranged at a portion of the frame that is adjacent to the wall at an adjustable angle, suitable to convey all the cooking fumes toward an extractor intake.

10 Claims, 2 Drawing Sheets

HOOD FOR COOKING AREAS

BACKGROUND OF THE INVENTION

The present invention relates to an improved hood for cooking areas.

It is well-known that it is necessary to install an extractor and/or filtering hood in rooms where cooking is performed.

The hood is in fact meant to absorb and filter odors and grease released together with the food cooking fumes and/or, where present, combustion products.

The hood must in fact be located above the cooking area, which is generally constituted by gas ranges or electric ranges or wood-fired stoves or others, so that the cooking fumes and any combustion products can be conveyed directly toward said hood.

In order to avoid ambiguities, it must be specified that the term "hood" in itself is inappropriate but it is used by the present invention to indicate devices for filtering and/or extracting odors and grease and/or combustion products (hereinafter termed fumes) in accordance with the usage of this term in the field.

Commercially available hoods are substantially constituted by a frame which supports a fan which conveys the fumes produced in the cooking area through a filtering element which usually contains grease filters (of the metallic, labyrinth, condensation and acrylic types) and for eliminating odors (activated-charcoal filters, catalyst filters).

Various hoods are commercially available which substantially differ in terms of their structure and method of installation.

So-called central extractor hoods are available, i.e., of the type which is fixed directly to the wall; chimney hoods, meant to be fixed to a wall; and recessed-mounting hoods, arranged inside a wall-mounted unit of a modular kitchen.

There are also hoods which are installed underneath a wall-mounted kitchen unit and built-in hoods which are fixed in the place of the wall-mounted unit and have a front finish which comprises a door of the same type as the other wall-mounted units of the kitchen.

In any case, an unpleasant drawback is noted due to the fact that part of the cooking fumes and grease enters the gap between the rear face of the hood (or of the wall-mounted unit in which the hood is included) and the wall (rear panel of the piece of furniture).

This drawback causes odors to spread into the environment and accumulates moisture on the wall, causing the deposition of grease and the formation of mold.

SUMMARY OF THE INVENTION

The aim of the present invention is to provide an improved convertible hood (extractor and/or filtering hood) which solves the abovementioned drawback of conventional hoods.

Within the scope of this aim, an important object of the present invention is to provide an improved convertible hood which has a simple constructive configuration and can be adapted to wall-mounted units having different depths.

Another object of the present invention is to provide an improved extractor hood whose cost is fully comparable with that of conventional hoods.

Another important object of the present invention is to provide an improved convertible hood which can be adapted to configurations having gaps of different depths.

Another object of the present invention is to provide an improved convertible hood whose installation requires no particular skill and can be performed in a manner which is substantially equivalent to the installation of conventional hoods.

Another object of the present invention is to provide an improved hood which can be provided as a chimney, recessed-mounting or under-unit model, so long as it is installed adjacent to a wall.

This aim, these objects and others which will become apparent hereinafter are achieved by an improved hood of the type to be mounted against a wall above a cooking area, comprising filtering elements and fan means which are integrated in a supporting frame and are connected to a control device, characterized in that it comprises a depth compensation device which is constituted by a contoured lamina arranged at a portion of the hood that is adjacent to said wall at an adjustable angle, suitable to convey the cooking fumes toward an extractor intake.

BRIEF DESCRIPTION OF THE DRAWINGS

Further characteristics and advantages of the present invention will become apparent from the following detailed description of a preferred embodiment thereof, illustrated only by way of non-limitative example in the accompanying drawings, wherein.

DESCRIPTION OF THE PREFERRED EMBODIMENTS

Figure 1:
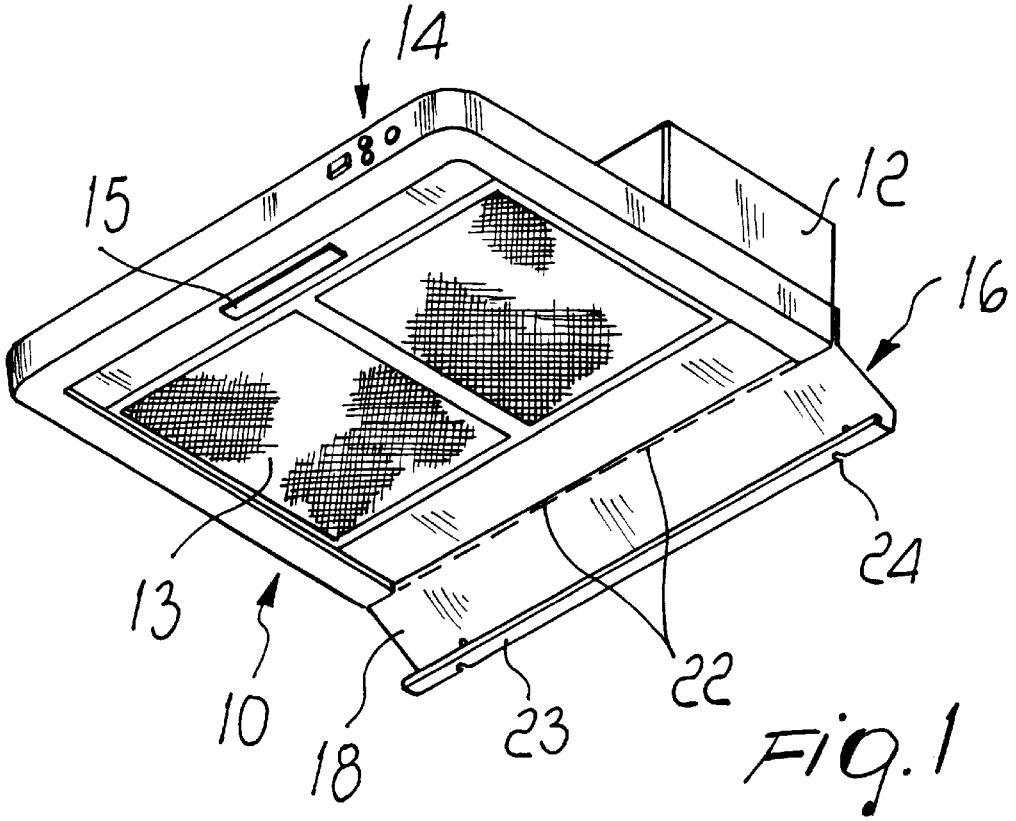
FIG. 1 is a perspective view, taken from below, of an improved hood according to the invention.
Figure 2:
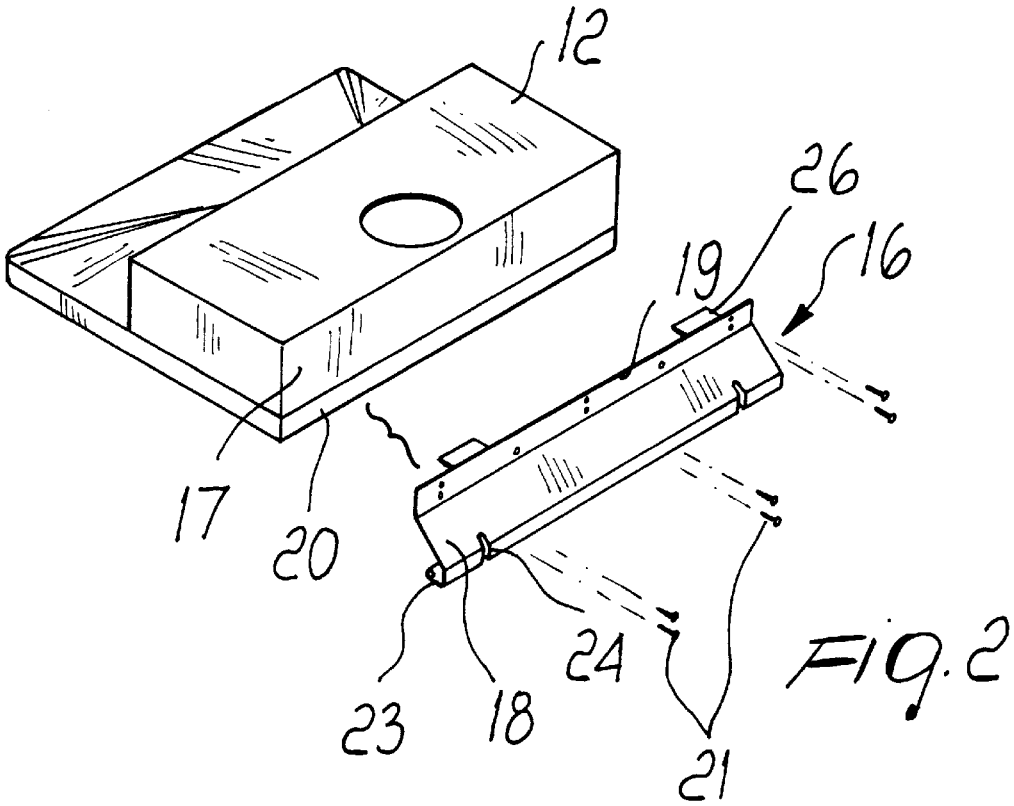
FIG. 2 is an exploded view of the hood of FIG. 1.
Figure 3:
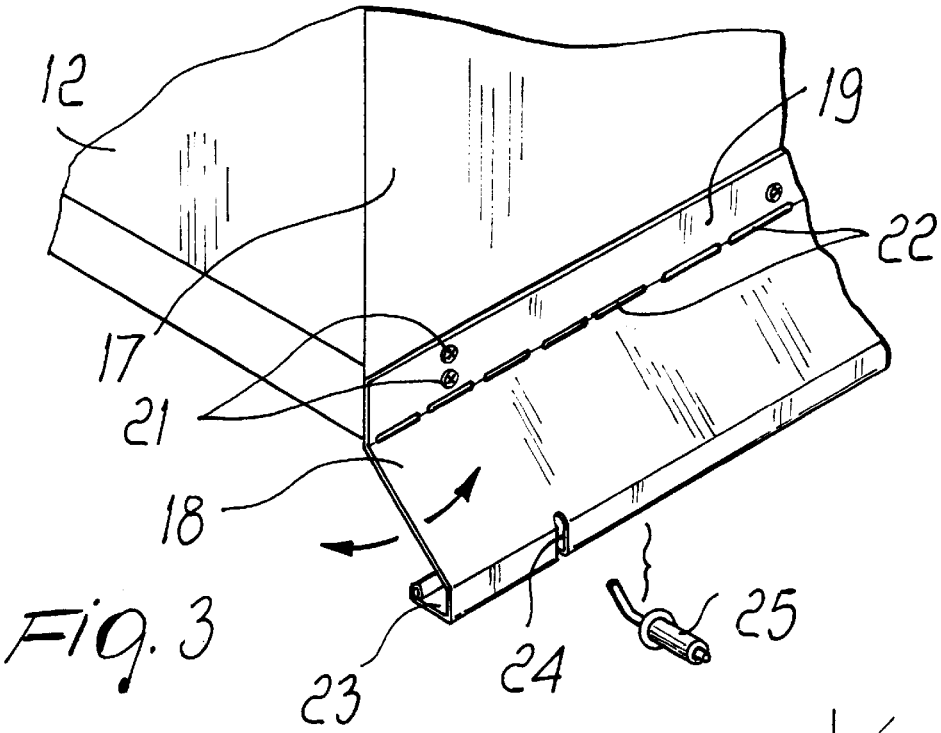
FIG. 3 is a perspective view of a detail of the hood of FIG. 1.
Figure 4:
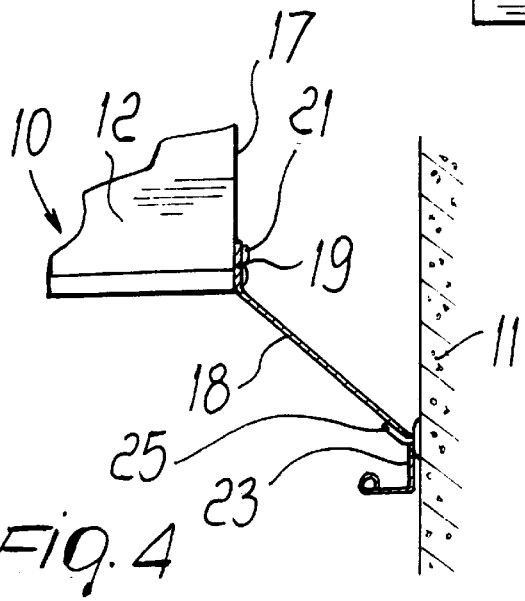
FIG. 4 is a sectional view of the detail shown in FIG. 3.
Figure 5:
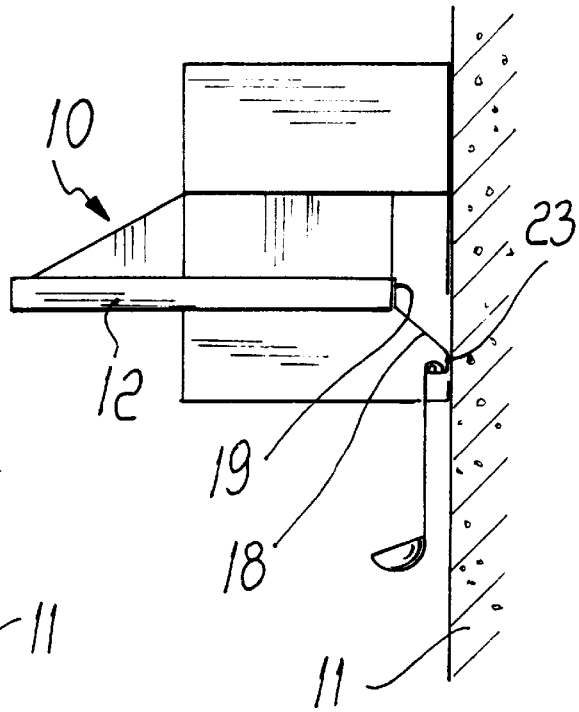
FIG. 5 is a side view of the improved hood of FIG. 1 in the operating configuration.

With reference to the above figures, an improved hood according to the invention is generally designated by the reference numeral 10 and is suitable to be fixed, in a per se known manner, to a wall 11 in a region overlying a cooking area, which is not shown in the above figures for the sake of simplicity.

The hood 10 comprises a contoured frame 12 for supporting filtering elements 13.

The hood 10 has a fan, also not shown in the figures, which is supported by the frame 12 and is connected to a control device 14.

The hood 10 also has, in this case, a lighting lamp 15 which can also be operated by means of a suitable switch of the control device 14.

As an alternative, the hood 10 can be provided with a luminaire in one or more parts, which is arranged in the lower portion of the hood 10 and can also be operated by means of the control device 14.

The hood 10 furthermore has a depth compensation device 16 which is fixed thereto at a rear face 17 of the frame 12 that must be placed against the wall 11.

The compensation device 16 is constituted by a contoured lamina 18, for example made of metallic material, which is as long as the rear face 17 of the frame 12.

In other and equivalent embodiments, the contoured lamina 18 can be obtained by means of another material, so long as it has adequate characteristics.

The lamina 18 is fixed, at a first longitudinal edge 19, to a corresponding lower edge 20 of the rear face 17 by means of fixing screws 21.

Likewise, the lamina 18 can be fixed to the rear face 17 of the frame 12 by means of other per se known engagement systems.

Mutually aligned longitudinal slots 22 are furthermore formed in the first edge 19 of the lamina, further inward with respect to the points for fixing by means of the screws 21, and guide the bending of the lamina 18 with respect to the longitudinal axis formed by the slots.

The second longitudinal edge 23 of the lamina 18 is shaped so as to form a curve and openings 24 are formed further inward with respect to said curve in order to fix the compensation device 16 to the wall 11 by means of screw anchors 25.

The lamina 18 can conveniently be folded at the longitudinal slots 22 and the resulting angle of inclination can be changed with respect to the plane formed by the filtering elements 13 so that the second edge 23 can lie adjacent to the wall 11.

Once the first edge 19 of the depth compensation device 16 has been fixed by means of the screws 21 to the lower edge 20 of the rear face 17 of the frame 12 and the second edge 23 has been fixed to the wall 11 by means of the screw anchors 25, the curve formed at the second edge 23 acts as a hanger on which it is possible to hang, for example, ladles or other tools used in the kitchen.

It should be noted that it is possible to form, on the first edge 19 of the lamina 18, in other embodiments, hinges 26 which lie parallel to the lower edge 20 of the rear face 17 which allow to vary the inclination of the lamina 18 with respect to the wall 11.

In any way, the depth compensation device 16 is capable of avoiding any dispersion of the cooking fumes, since it is capable of adapting to gaps of different depths between the rear face 17 and the wall 11.

In practice it has been observed that the present invention fully achieves the intended aim and objects.

In particular, an important advantage is achieved with the present invention in that an improved hood has been provided which ensures that all cooking fumes are conveyed toward the extractor intake without resorting to complicated constructive configurations.

Another advantage is ensured to the present invention by virtue of the fact that a hood has been provided which can adapt to solutions having different depths.

Another advantage of the present invention has been achieved in that an improved hood has been provided which offers an additional tool which increases the practicality of use of the cooking area beneath said hood.

Another advantage is achieved with the present invention in that an improved hood has been provided which can be manufactured at a cost which is fully comparable to that of conventional hoods.

The present invention is susceptible of numerous modifications and variations, all of which are within the scope of the same inventive concept.

All the details may furthermore be replaced with other technically equivalent elements.

The materials employed, so long as they are compatible with the contingent use, as well as the dimensions, may be any according to requirements.

The disclosures in Italian Patent Application No. PD97U000086 from which this application claims priority are incorporated herein by reference.

What is claimed is:

1. A hood of the type to be mounted against a wall above a cooking area, comprising filtering elements and fan means which are integrated in a supporting frame and are connected to a control device, comprising a depth compensation device which is constituted by a contoured lamina arranged at a portion of the hood that is to be faced toward said wall at an adjustable angle, suitable to convey all the cooking fumes toward an extractor intake, said portion of the hood being separate from the wall and said contoured lamina being foldable at a first edge opposite to a second edge which is connected to said portion of the hood, in order to connect said first edge to the wall, keeping said portion of the hood separate from the wall.

2. The hood according to claim 1, wherein said contoured lamina is as long as said frame and is fixed thereto at a rear face of the frame that is arranged adjacent to said wall.

3. The hood according to claim 2, wherein said contoured lamina is fixed to a lower edge of said rear face and has mutually aligned slots which lie parallel to said edge, said slots guiding the adjustable bending of said lamina with respect to the axis formed by said slots.

4. The hood according to claim 2, wherein said contoured lamina is fixed to a lower edge of said rear face and is provided with hinges which lie parallel to said edge, said hinges allowing the adjustable folding of the lamina with respect to the axis formed by said hinges.

5. The hood according to claim 1, wherein said lamina has, at said first edge lying opposite to the second edge that is fixed to said portion of the hood, openings for fixing said Mona to said wall once said first edge has been folded.

6. The hood according to claim 5, wherein said first edge provided with openings is shaped so as to form a curved portion.

7. A hood of the type to be mounted against a wall above a cooking area, comprising filtering elements and fan means which are integrated in a supporting frame and are connected to a control device, comprising a depth compensation device which is constituted by a contoured lamina arranged at a portion of the hood that is adjacent to said wall at an adjustable angle, suitable to convey all the cooking fumes toward an extractor intake, wherein said contoured lamina is as long as said frame and is fixed thereto at a rear face of the frame that is arranged adjacent to said wall and said contoured lamina is fixed to a lower edge of said rear face and has mutually aligned slots which lie parallel to said edge, said slots guiding the adjustable bending of said lamina with respect to the axis formed by said slots.

8. The hood according to claim 7, wherein said contoured lamina is fixed to a lower edge of said rear face of the frame and is provided with hinges which lie parallel to said edge, said hinges allowing the adjustable folding of the lamina with respect to the axis formed by said hinges.

9. The hood according to claim 7, wherein said lamina has, at an edge lying opposite to an edge that is fixed to said frame, openings for fixing said lamina to said wall once it has been folded.

10. The hood according to claim 9, wherein said edge provided with openings is shaped so as to form a curved portion.

* * * * *